United States Patent [19]

Mascetti

[11] 4,105,121

[45] Aug. 8, 1978

[54] PACKAGE WITH MEDIAN SUPPORTING FRAME AND INTEGRAL DECORATIVE MEDIAL BAND

[75] Inventor: Joseph A. Mascetti, Glen Ellyn, Ill.

[73] Assignee: Plastofilm Industries, Inc., Wheaton, Ill.

[21] Appl. No.: 794,832

[22] Filed: May 9, 1977

[51] Int. Cl.[2] ..... B65D 85/30

[52] U.S. Cl. ..... 206/592; 206/459; 220/410; 220/306; 220/352

[58] Field of Search ..... 206/592; 220/17, 23, 220/23.83, 306–307, 352, 354

[56] References Cited

U.S. PATENT DOCUMENTS

| | | | |
|---|---|---|---|
| 3,070,275 | 12/1962 | Bostrom | 220/17 X |
| 3,349,941 | 10/1967 | Wanderer | 220/17 |
| 3,412,888 | 11/1968 | Andrews et al. | 220/17 X |
| 3,452,921 | 7/1969 | Donovan | 229/1.5 B X |
| 3,621,855 | 11/1971 | Rabinowitz | 220/17 |

*Primary Examiner*—Steven E. Lipman

*Attorney, Agent, or Firm*—Darbo & Vandenburgh

[57] ABSTRACT

A three-piece package comprises a median supporting frame to which a dished base and a dished cover are latched by means of double-acting latch elements integral with the supporting structure, all three parts being preferably thermoformed plastic to provide the package in one, two, or three colors. The supporting structure may include an integral platform having one or more cavities therein to accommodate as many articles and may also support a decorative peripheral band or may comprise a frame with either an open interior with unobstructed space between the base and cover of the package or a separate platform with a cavity or cavities.

11 Claims, 15 Drawing Figures

Fig. 1.
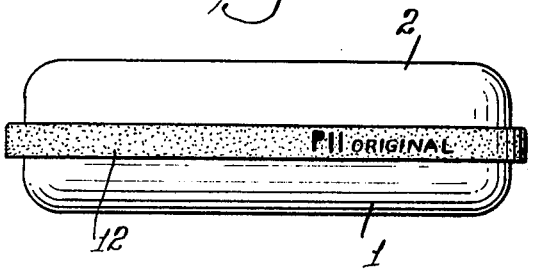
Fig. 3
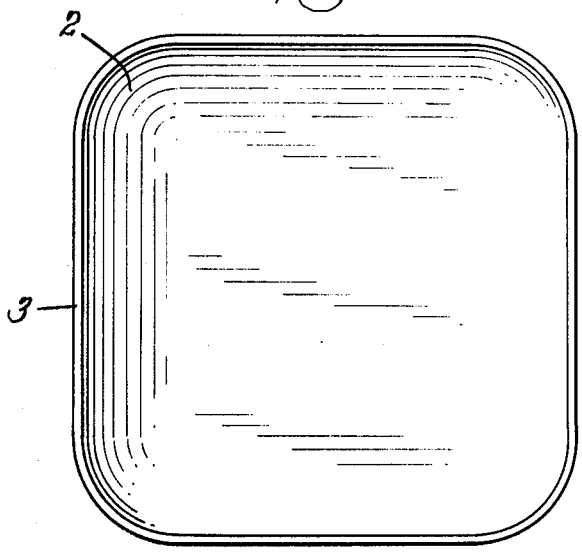
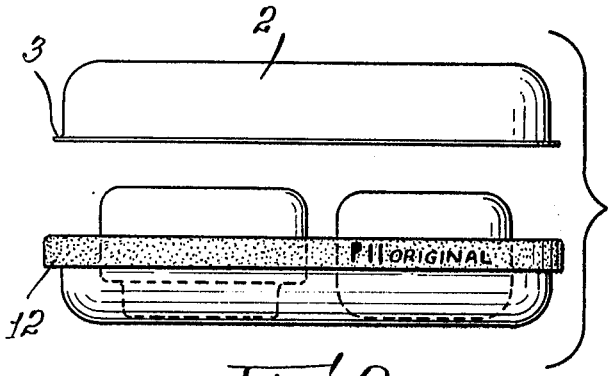
Fig. 2.
Fig. 10.
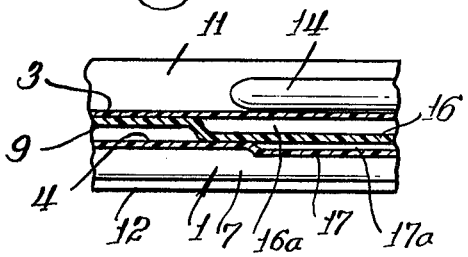
Fig. 4
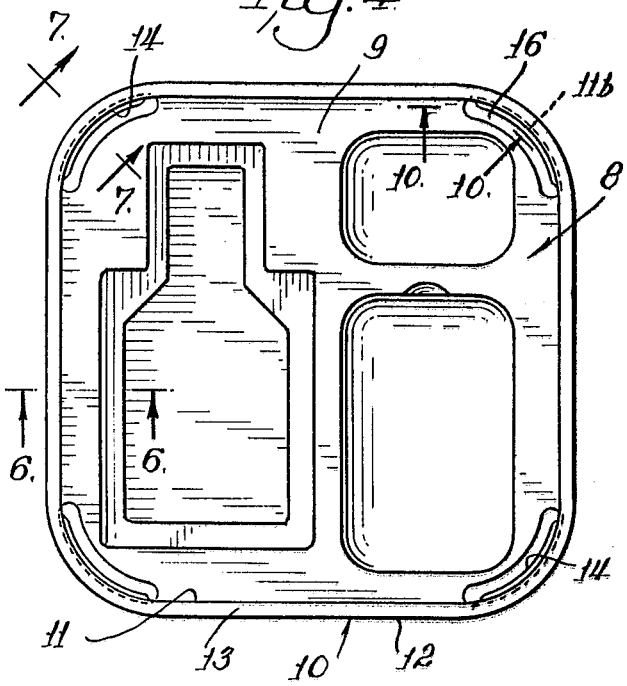
Fig. 5
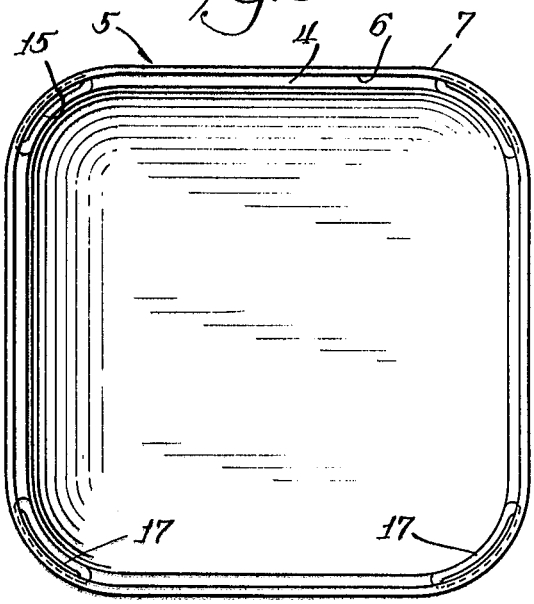

PACKAGE WITH MEDIAN SUPPORTING FRAME AND INTEGRAL DECORATIVE MEDIAL BAND

BACKGROUND AND SUMMARY OF THE INVENTION

Packaging provided primarily for containing and protecting particles or material must also be esthetically attractive and, usually, provide space for trademarks, description of the contents and other information. Because too frequently packaging possessing all of these qualities is relatively very expensive, especially in relation to the value of the contents, cost reduction without impairment of appearance or function is highly desirable. In general, for rigid and semi-rigid packaging, thermoforming from suitable plastic film offers lowest cost but frequently entails compromise in appearance and structural aspects. Thus, manufacturing savings are sometimes partly sacrificed by the need to separately embellish the simple thermoformed packages.

One type of very attractive package is that which consists of a simple enclosure comprising identical dished top and bottom members with a median band encircling the package to decorate it and, perhaps, provide space for trademark and other indicia. Such a median band has been fastened to the package as a separate element at substantial cost.

The concept of the present invention contemplates a package having a median supporting frame structure which provides efficient latching means to hold the base and lid together, provide, if desired, a cavity or cavities formed to snugly receive an article or articles therein and, as an integral part of the supporting frame, provide an external equator or median band for greater strength and rigidity and also as ornamentation and to provide space for further ornamental or informational indicia. When designed as a fitted container for one or more articles, the exterior surfaces of the cavities are not exposed but are shrouded by the package base to present the desirable appearance of "expensive simplicity".

The package may be provided in one, two or three colors or, if desired, the lid, for example, may be transparent or translucent so that the contents may be viewed. Since, especially in the fitted packaging, the load is carried by the median supporting structure, the base and lid may be made of relatively thin, and therefore inexpensive, plastic material.

It is, accordingly, an object of the invention to provide an efficient, very attractive but relatively inexpensive package having the advantages and attributes described.

DESCRIPTION OF THE DRAWINGS

In the accompanying drawings,

FIG. 1 is a side view of a package embodying the invention described herein;

FIG. 2 is a view similar to that of FIG. 1 showing the package with the lid elevated and showing articles in position in the supporting frame structure and base;

FIG. 3 is a bottom view of the lid of the package;

FIG. 4 is a plan view of the package with the lid removed;

FIG. 5 is a top view of the base of the package;

FIG. 10 is a detailed view in cross section taken at the curved line 10—10 of FIG. 4;

DESCRIPTION OF PREFERRED EMBODIMENTS

Figure 6:
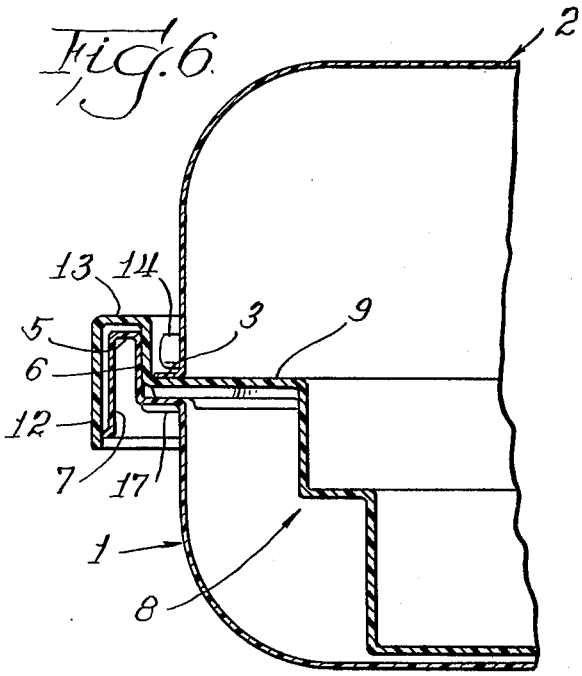
FIG. 6 and 7 are partial, cross-sectional views taken, respectively, at the lines 6—6 and 7—7 of FIG. 4.

By way of example of the invention, a package of esthetically and functionally simple design and space-efficient rectilinear shape and having the ornamental and useful median band is shown in the drawings. A dished base 1 and dished lid 2 confront each other to enclose the desired load space. Lid 2 is a simple dished cover having a narrow peripheral flange 3 which serves to stiffen the lid and, as will be seen, also provides latching means for securing the lid in closed position in the package.

The dished base 1 is similar in general shape to lid 2. Whereas lid 2 is provided with a horizontal flange 3, base 1 opens at a shoulder 4 at the periphery of which is a retroverted flange 5 having an inner part 6 which rises from shoulder 4 and an outer depending skirt 7.

The median supporting frame structure 8 of the package is shown in plan in FIG. 4 and in cross section in the enlarged views of FIGS. 6–10. In the fitted package shown in the drawing, the median supporting structure comprises a platform 9 having an integral peripheral frame 10 formed by the peripheral margin of platform 9, upstanding flange 11, depending flange 12 and bridging portion 13 which connects the two flanges forming a box frame structure.

The frame 10, being integral with platform 9, provides a rigid supporting structure for the package. The frame also carries latching means for engagement by both the base and lid of the package for holding these parts of the package together. The latching means consist of inwardly impressed arcuate catch beads 14 which provide not only a male latch detent facing inwardly in upstanding flange 11 but also a female detent **14*a* in the opposite side of flange 11**.

Figure 7:
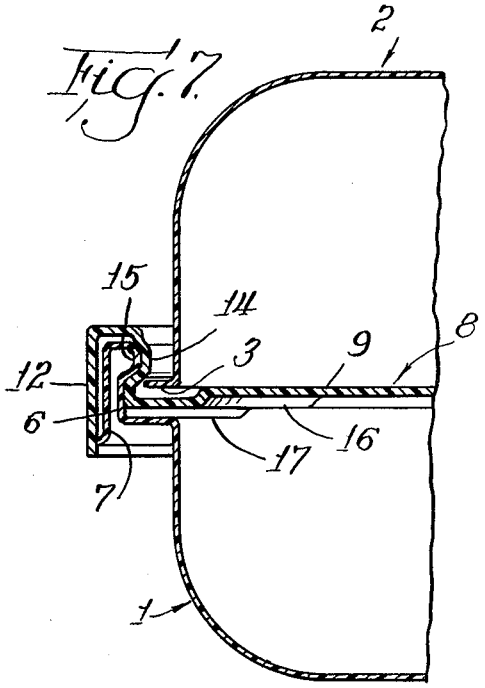
Figure 8:
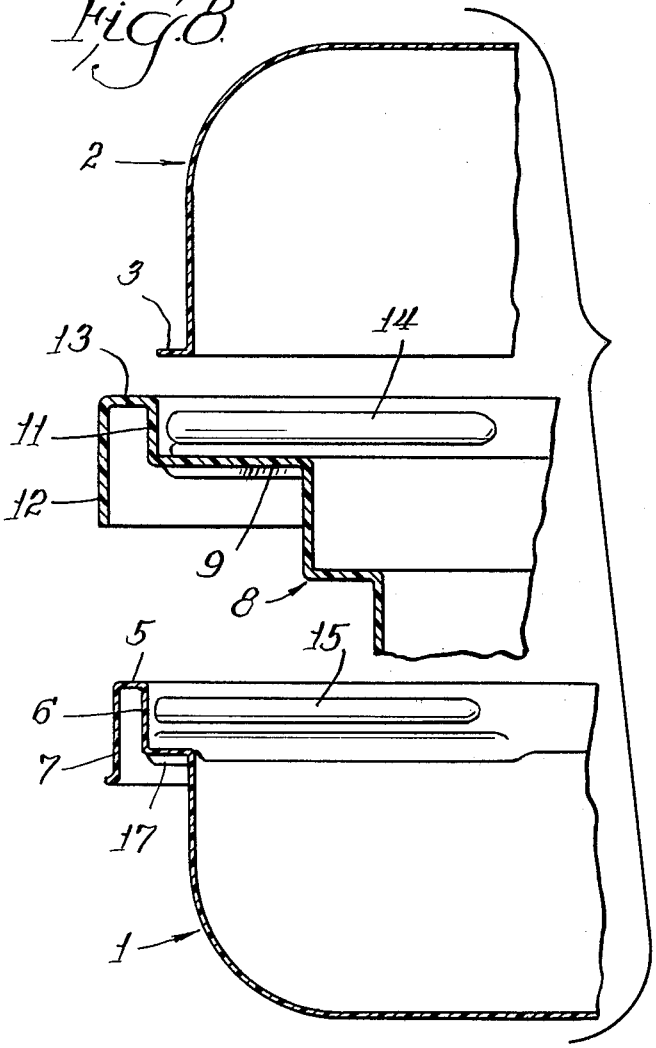
FIGS. 8 and 9 are exploded views corresponding, respectively, to FIGS. 6 and 7.
Figure 9:
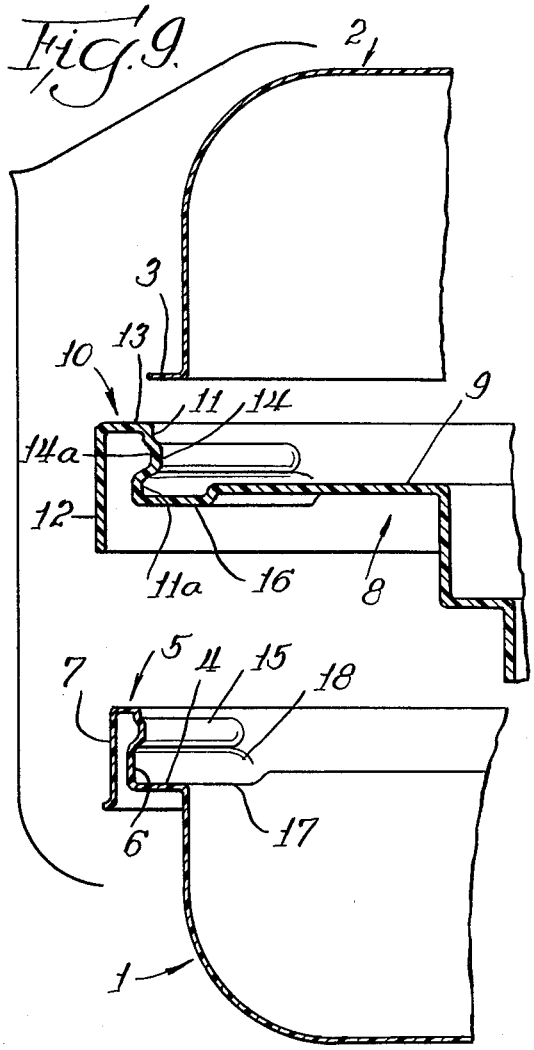

Referring to the enlarged, detail views of FIGS. 7 and 9, it is seen that flange 3 of package lid 2 engages the underside of the male detent bead 14 when the lid is pressed into closed position, the flange slipping past bead 14 as the lid is pressed home. Similarly, an arcuate bead 15, inwardly formed in the inner part 6 of retroverted flange 5 of the base of the package, engages female detent **14*a* after slipping over the lower part of flange 6** as the base of the package is pressed home against the median supporting frame structure.

As is seen from the foregoing, the catch or detent elements of the latch structures for retaining both the base and lid of the package to the median frame are designed and built into the inner part 6 of the retroverted flange 5. The arcuate bead 14 provided at each of the four corners of the frame 10 serves as the catch or detent for both the base and the lid of the package. While not indispensable, crispier latches are achieved by depressing the peripheral portions 16 of platform 9 which are immediately adjacent to beads 14 a little below the plane of platform 9 so that greater space is provided in the lower portion 11*a* of flange 11 for the unobstructed entry thereinto of flange 3. At the same time, the portions, 11*a* may be bulged slightly outwardly, as indicated in dotted lines 11*b* (FIG. 4), to thereby increase the relative depth of detent groove 14*a*. The arcuate beads 15 are located and designed to snap into detent grooves 14*a* after slipping past surfaces 11*b* as the base of the package is pressed against the median supporting frame 8.

Advantageously, the peripheral portions 17 of shoulder 4 which are immediately adjacent beads 15 at the corners of the base of the package may be depressed somewhat below the level of shoulder 4 to increase the depth of the space 18 for the unobstructed reception of the portions 11*a* of the median supporting frame.

Dual clean-snapping latches are provided by the latch elements thus described and carried by the flanges of the base and lid, respectively, of the package and the inner flange of the median supporting frame. Space efficiency and manufacturing economy are achieved by employing a common detent structure to receive and catch the flanges of the base and lid of the package. The parts of the package so latched together may easily be separated by pulling them apart, the resilience of the plastic material being sufficient to such unlatching.

The relative positions of the latching parts are shown in the enlarged cross-sectional view of FIG. 7.

As is seen in the detail view of FIG. 10, when the package is closed, the normal surface of platform 9 serves as a stop to be engaged by flange 3 of package lid 1, a clearance space 16*a* being left under flange 3 at the corners where the latches are located. Similarly, shoulder 4 of base 1 engages the bottom surfaces of depressed peripheral portions 16, leaving a clearance space 17*a* under bead 14. These clearance spaces enhance the action of the latching structures, making possible easy closing and firm latching without looseness or play.

In the finished, closed package, median band 12, given the appearance of depth and substance by the bridging portion 13, provides striking ornamentation when its color or finish differs from, but complements, the color or finish of the base and lid of the package. This desirable appearance is suggested by the stippling of the base and lid surfaces in FIGS. 1 and 2. In side view, only the face of the median band is visible while from the top an attractive frame is suggested. In addition to the use of plastic film of different colors, it is also possible by known techniques to flock, for example, the base and lid surfaces to give the appearance of, for example, suede. Also, as is indicated in FIG. 1, limited indicia may be carried by the median band. The flange which forms the band is given support by flange 7 of base 1 which is hidden behind the band.

Figure 11:
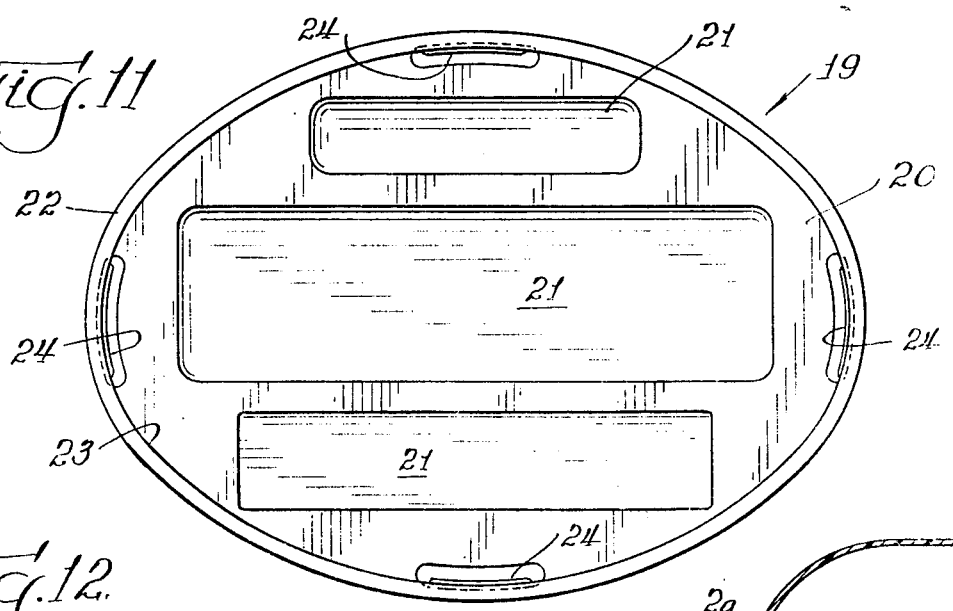
FIG. 11 is a plan view similar to that of FIG. 4 but showing an oval package.

It should be understood that the package need not necessarily be square, or even rectilinear, but may be any desired shape, such as the oval package shown in plan with the lid removed in FIG. 11. While some shapes automatically orient engaging parts so that mating latch elements engage each other, as in the cases of the square and oval packages, it is possible to employ the advantageous structure of the invention in a circular package provided means for relatively orienting the engaging parts are provided.

The structure of the oval package of FIG. 11 is similar to that already described with reference to the square package illustrated in FIGS. 1–10. The median supporting structure 19 with integral platform 20 having article-receiving cavities 21 therein carries peripheral frame 22 formed in part by inner flange 23 upon which are formed the four latching beads 24 which catch and retain the peripheral flange of an oval lid, not shown, and the latch beads provided on the upstanding flange of the base of the package not separately shown in FIG. 11 but described in detail with reference to the package of FIGS. 1–10. As in the case of the square package, the lid and base of the package snap into closed position against the median supporting structure 19 subject to the removal of the lid or separation of the base and supporting structure by pulling the mating parts apart.

Figure 12:
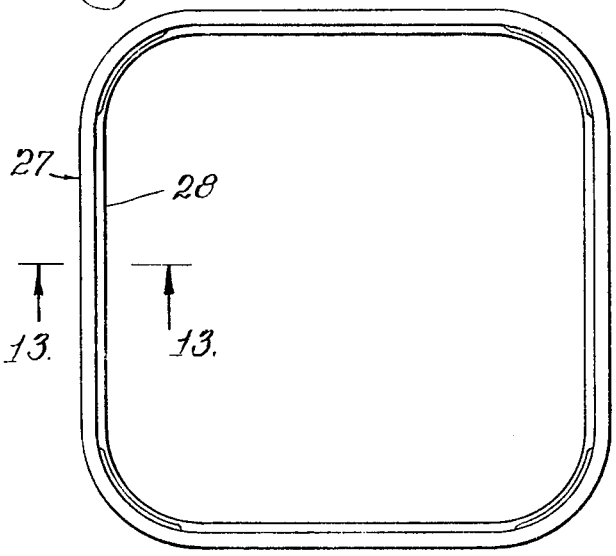
FIG. 12 is a plan view of a modified form of package employing the median supporting frame without a product platform.
Figure 13:
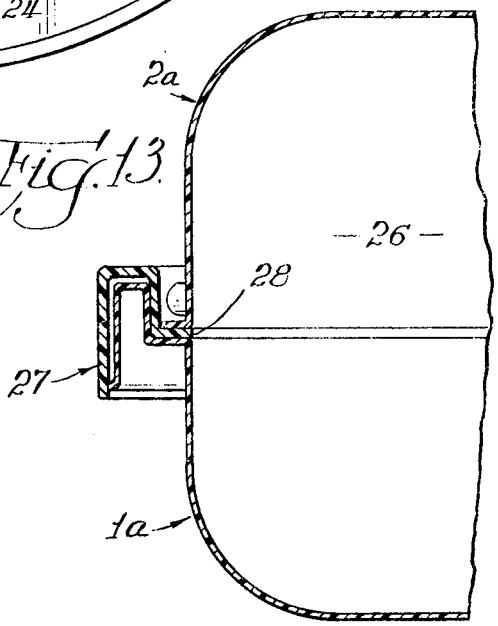
FIG. 13 being a cross-sectional view of this package taken at the line 13—13 of FIG. 12 but including the lid.

While in the fitted type of package, it is not only convenient but efficient from many viewpoints to provide an article holding platform integral with the median supporting frame, if a package having entirely open interior is desired, the median supporting frame of the invention may be employed without inclusion of the interior platform. Such a package is illustrated in FIGS. 12 and 13. In this form of the package of the invention, base 1*a* and lid 2*a* confront each other to enclose unobstructed space 26, being latched, respectively, to median supporting frame 27 in the manner and by latching means described in detail with reference to FIGS. 1–10. In the package of FIGS. 12 and 13, the inner edge 28 of median supporting frame 27 may be flush with the adjoining interior surfaces of the base and lid of the package or, if desired for additional strength, the frame structure may include a depending flange which engages the top portion of the base 1*a*. This alternative design detail is not shown.

Figure 15:
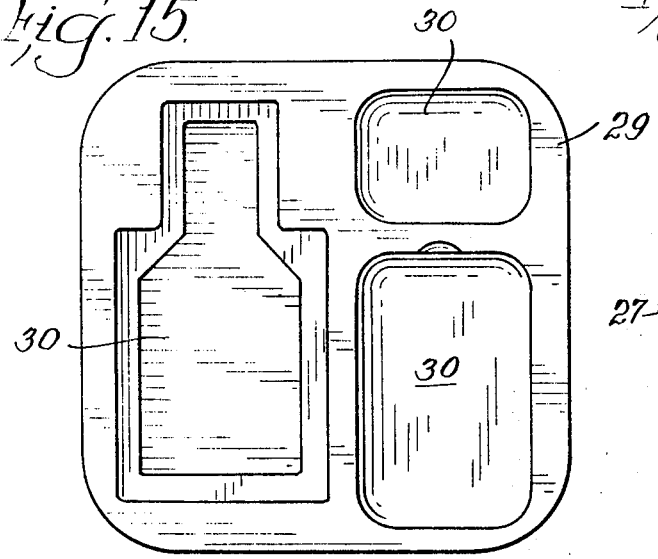
FIG. 15 is a plan view of the separate platform of the assembly of FIG. 14.
Figure 14:
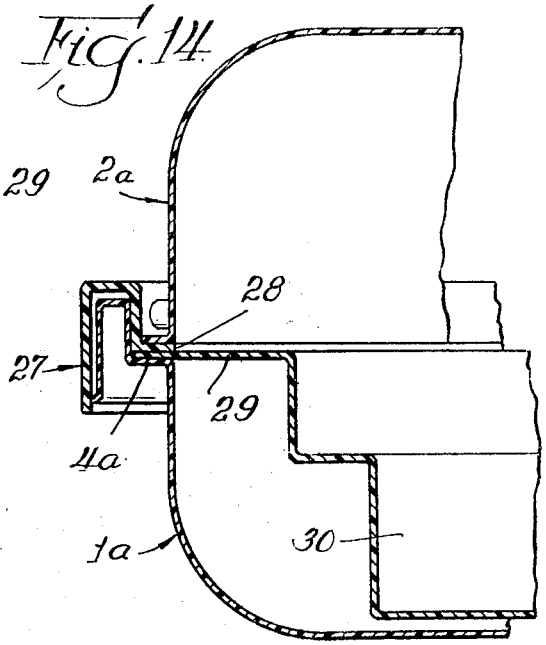
FIG. 14 is a cross-sectional view showing a further modification employing the separate platform with the median frame shown in FIGS. 12 and 13.

It is possible to adapt the package structure of FIGS. 12 and 13 to provide fitted types of packaging by providing, in the manner shown in FIGS. 14 and 15, separate, custom-designed platforms having cavities conforming to the configuration of the article or articles to be carried by the packages. Thus, a platform 29 having cavities 30 is formed as a separate part of the package and clamped in the package assembly between median supporting frame 27 and shoulder 4*a* of the base of the package. It will be understood, of course, that the thickness of the plate must be taken into account in designing the mating latching elements of the base and frame so that the assembly will be latched and held firmly together.

The obvious advantage of employing the same median supporting frame structure in packages having an endless variety of platform configurations resides in the saving of tooling costs. While the plastic material removed from the central areas of the frames may be wasted, this may amount to considerably less than the added cost of making molds which include the supporting frame, especially for relatively small production quantities.

It will be understood from the foregoing that the invention herein described and shown provides advantages in several aspects of package design, manufacture and use. It offers great flexibility in appearance, provides desirable space for trademarks and other indicia, is economical to manufacture and is in every way an efficient package since it can be easily filled and assembled, remains dependably and firmly closed, and may be opened with relative ease.

While the embodiments shown and described herein represent the best mode of carrying out the invention presently contemplated by the inventor, it will be understood that the inventive concepts may be adapted to a wide variety of packages designed to meet particular requirements. Also, the structural details may be altered. For example, there is no indispensable need for a shoulder 4 at the open top of the base of the package; the sides of the base could extend straight up to include flange 6 which carries essential latching elements. The base and lid, described herein as dished, may be some other configuration or either may be essentially flat. In place of flange 3, a bead may be formed inwardly in the portion of the lid adjacent its periphery to receive and mate with bead 14 to latch the lid to frame 10. Also, skirt 7, while desirable, is not indispensable. Other aspects of design of the package may be varied while still incorporating the essential concepts of the invention as defined by the claims appended hereto.

I claim:

1. In a package including mutually confronting dished base and dished lid, said base and lid being mutually conforming at their peripheries, the improvements which comprise a median supporting frame conforming in size and shape to the peripheries of the base and lid and arranged therebetween and having an upstanding flange located between the overlapping peripheral portions of the base and lid, and means for latching both the base and the lid to said frame, said means comprising latching means elements on the peripheries of the base and lid and detent configurations in said upstanding flange with which said latching means elements respectively mate to latch the base and the lid respectively to said frame, said latching means elements on the periphery of the lid comprising a flange extending outwardly from the periphery of the lid and the detent configurations in the flange of the frame comprising inwardly impressed arcuate beads adapted to receive and hold said lid peripheral flange thereunder, said latching means elements on the periphery of the base comprising arcuate beads inwardly formed in the peripheral portion of the base located and shaped to mate with the inwardly impressed arcuate beads in the flange of the frame to latch the base to said frame.

2. Package structure in accordance with claim 1 and including a retroverted flange integral with the median frame and which includes the upstanding flange of the frame as the inner flange thereof, said retroverted flange including a depending flange which surrounds the median frame and thus the package.

3. Package structure in accordance with claim 1 wherein the package is oval shaped and four separate sets of intermating beads are provided in base and frame and located respectively at the ends of the major and minor axes of the oval.

4. Package structure in accordance with claim 1 and including a product-supporting platform medially spanning the interior of the package, said platform being integral with the median supporting frame.

5. Package structure in accordance with claim 1 and including a product-supporting platform medially spanning the interior of the package, said platform being separate from but supported by the medial frame.

6. In a package including mutually confronting dished base and dished lid, said base and lid being rectilinear with curved corners and mutually conforming at their peripheries, the improvements which comprise a median supporting frame conforming in size and shape to the peripheries of the base and lid and arranged therebetween, said frame including an L-shaped structure formed by an upstanding flange and a median structure extending inwardly from the base of said flange, and means for latching both the base and lid to said frame, said means comprising an arcuate bead inwardly impressed in said upstanding flange at each corner portion of the package, said lid having a flange extending outwardly from the periphery of the lid and adapted to catch under said beads to thereby latch the lid to said frame, said base having a shoulder near the periphery thereof and a flange rising from said shoulder at the periphery of the base, said base flange having beads inwardly impressed therein to mate with said beads in said upstanding flange of said frame to thereby latch the base to said frame, said lid peripheral flange and said base shoulder engaging said frame median structure in the assembled and latched package.

7. Structure in accordance with claim 6 wherein the portions of the median structure under the beads in the upstanding flange of the frame are depressed below the general level of said median structure to provide augmented space under said beads to receive the flange of the package lid.

8. Structure in accordance with claim 6 wherein the portions of the base shoulder under the beads in the base flange are depressed below the general level of said shoulder to provide augmented space under said beads to receive the portions of the upstanding flange of the frame immediately below the beads therein to enhance the latching of the base to said frame.

9. Structure in accordance with claim 6 and including a decorative band integral with the frame and medially surrounding the package.

10. Package structure in accordance with claim 6 and including a product-supporting platform medially spanning the interior of the package, said platform being integral with the median structure of the frame.

11. Package structure in accordance with claim 6 and including a product-supporting platform medially spanning the interior of the package, said platform being separate from the frame, said platform being clamped at its periphery between the shoulder of the base of the package and the median structure of said frame.

* * * * *